United States Patent [19]

Criscimagna et al.

[11] Patent Number: 4,622,549

[45] Date of Patent: Nov. 11, 1986

[54] REPETITION RATE COMPENSATION AND MIXING IN A PLASMA PANEL

[75] Inventors: Tony N. Criscimagna, Woodstock; Harry S. Hoffman, Jr., Saugerties; Thomas J. Milich, New Windsor, all of N.Y.

[73] Assignee: International Business Machines Corporation, Armonk, N.Y.

[21] Appl. No.: 509,001

[22] Filed: Jun. 29, 1983

[51] Int. Cl.[4] ..... G09G 3/26

[52] U.S. Cl. ..... 340/805; 340/767; 340/771

[58] Field of Search ..... 340/767, 805, 793, 771, 340/776, 779

[56] References Cited

U.S. PATENT DOCUMENTS

| | | | |
|---|---|---|---|
| 3,886,403 | 5/1975 | Owaki et al. | 315/169 R |
| 4,097,780 | 6/1978 | Ngo | 315/169 TV |
| 4,149,111 | 4/1979 | Coates, Jr. | 315/169.4 |
| 4,350,932 | 9/1982 | Coleman et al. | |
| 4,464,657 | 8/1984 | Marentic et al. | 340/767 |

FOREIGN PATENT DOCUMENTS 2101178A 1/1983 United Kingdom .

2102179A 1/1983 United Kingdom .

OTHER PUBLICATIONS

IBM Technical Disclosure Bulletin, vol. 23, No. 11, Apr. 1981 to H. S. Hoffman, Jr., "Quiet Repetition Rate Control of a Gas Panel", p. 4989.

IBM Technical Disclosure Bulletin, vol. 24, No. 10, Mar. 1982 to T. N. Criscimagna, "Gas Panel Brightness Control", pp. 5203-5204.

*Primary Examiner*—Marshall M. Curtis

*Attorney, Agent, or Firm*—James A. Kunkle; Joseph F. Villella; J. J. Connerton

[57] ABSTRACT

Operation of an AC plasma display panel requires the three control operations of write, erase, and sustain. Sustain, write and erase signals are stored in a plurality of sections in a storage device and the sections are selectively accessed according to the specific operation to be provided to the plasma panel display. The control signals stored within a given sequence are selected so that no dimming occurs during write and erase operations. A brightness control is provided to modulate the average repetition rate of signals applied to the plasma display panel. In this manner, a plurality of flicker-free brightness levels may be chosen.

17 Claims, 4 Drawing Figures

REPETITION RATE COMPENSATION AND MIXING IN A PLASMA PANEL

CROSS REFERENCE TO RELATED APPLICATIONS

U.S. application, Ser. No. 372,384 "Method and Apparatus for Gas Display Panel", filed by Tony N. Criscimagna and Albert O. Piston, June 21, 1973.

U.S. application, Ser. No. 386,493 "ROS Control of Gas Panel", filed by Larry R. Zucker and Kenneth A. Pearson, June 9, 1982.

TECHNICAL FIELD

This invention relates to an AC plasma panel display system using read only storage (ROS) for control sequencing to prevent flicker and provide brightness control.

BACKGROUND ART

Conventional AC plasma display technology includes display panels comprising two glass plates having orthogonally positioned conductor arrays thereon encapsulated in a gas envelope, the intersections of said conductor arrays forming gas cells. The conductor arrays are overcoated with a dielectric and insulated from the gas and thus capacitively coupled to the gas in the panel. When signals exceeding the ionization potential of a pair of conductors occur during a write operation, a discharge takes place and a wall charge potential is formed on the cell walls. This potential combines with a lower level sustain signal to continually discharge the cell at a relatively high frequency (40 KHz) to maintain the discharge. Erase takes place by neutralizing the wall charge and thereby removing the wall charge potential.

The operation of an AC plasma display panel thus requires the application of sequences of three control signals, i.e., sustain, write and erase. These signals are applied to drivers which control the energization state of the illuminable cells in the plasma panel display and are sequenced so as to provide the sustain, write and erase operations required in the plasma panel display. The sustain operation has two separate applications. The first application, as described above, is to maintain the information on the plasma panel display in its then present state. The second application is to normalize a write or an erase operation by a sustain sequence. If the sustain sequence is not properly applied before and after write and erase operations, then a write or erase operation will not be successfully completed.

A plasma panel display may be controlled by a data processing system or controller which serves two purposes in relation to the display. First, it sends data signals which are representative of the information that is to be displayed. Second, it sends the control commands, such as write or erase, which cause the information to be displayed by or erased from the plasma panel display. These control commands are received by the plasma panel through appropriate control circuitry and are operated upon so as to effect the appropriate control operations of write, sustain and erase.

One method of accomplishing such plasma panel control is disclosed in U.S. Pat. No. 3,851,211 where individual control sequences of the sustain, write and erase signals are stored within a ROS. Logic circuitry within the panel assembly but external to the ROS receives the control information from a data processing system or controller. The logic circuitry then selectively activates the appropriate control sequences of sustain, write and erase within the ROS so as to effect control of the plasma panel display.

As the cost of storage continues to decline, it would be desirable to provide control of the individual operations of sustain, write and erase within a storage device located in the plasma panel assembly. By so doing, the external logic circuitry required in the prior art is simplified.

As previously described, the application of sequences of the sustain signal has two functions. The first function is to continuously discharge the cells in the plasma display so as to maintain the discharge. The second function is to normalize a write or an erase operation, i.e., to successfully complete a write or an erase operation. The sustain signal operates at a relatively high frequency of 40 kilohertz. On the other hand, the erase and write signals operate at a much lower frequency, around 20 kilohertz.

At this point, a digression is in order to explain the relationship between frequency and repetition rate. As is well known, frequency is defined as the reciprocal of the period of a periodic waveform. However, when one has a signal composed of sequences having a multiplicity of periods, it is no longer correct to speak in terms of frequency for the entire signal. Instead, the proper term describing this type of signal is repetition rate. The repetition rate is found by averaging the individual periods found in a nonperiodic waveform and taking the reciprocal of them. Note that for a periodic waveform, the frequency will be equal to the repetition rate.

The individual sequences of the sustain signal, erase signal, and write signal, are periodic. As previously disclosed, the sustain signal has a frequency of 40 kilohertz. The erase and write signals are somewhat slower having a frequency of 20 kilohertz. In order to carry out an erase or a write operation, the erase or write signals must be followed by sequences of sustain signals. Thus, for example, an erase function comprises sequences of the erase signal combined with sequences of the sustain signal. In this type of situation, the waveform comprising the erase function must be characterized by use of the term repetition rate since it includes signals of different frequencies.

The brightness of the illuminable cells in a plasma panel display are directly proportional to the repetition rate of control signals applied thereto. A problem that arises as a result of this phenomenon and the disparity in frequency between the sustain, and the write and erase signals is that the plasma panel becomes dimmer during long periods of write and erase functions. This occurs because the average repetition rate of control signals applied to the cells decreases over the average repetition rate during a sustain function.

Several attempts have been made to suppress this dimming effect during write or erase sequences, however none of them are totally satisfactory. One approach involved requiring the display panel to be deenergized during a time interval immediately preceding an erase function. However, this approach did not eliminate dimming, but only reduced a portion of it. Another approach involved reducing the repetition rate during a write sequence until the light is substantially unperceivable in a room ambient light background. After the write is completed, the repetition rate is increased until the panel is once again visually perceivable. Both of these approaches are unattractive since they require the plasma panel to deviate from its normal operating mode during writing or erasing.

This problem is solved in the instant invention by mixing high frequency sustain signals with erase and write signals chosen so that the average repetition rate of the signals comprising an erase function and a write function are equal to the average repetition rate of the signals comprising the sustain function. By having a uniform repetition rate for the functions of sustain, erase and write, no dimming occurs.

It would be desirable when operating a gas panel to be able to vary the average brightness of the panel. With this capability, one would be able to adjust the brightness of a plasma panel display so as to improve perceptibility in different ambient light backgrounds. It would also be most desirable to combine the brightness modulation control with the antiflicker mechanism. This is accomplished in the instant invention by storing in a ROS a multiplicity of sustain, write and erase signals. The various signals may be combined to produce an average repetition rate at a given brightness level. This suppresses flicker and provides the capability of mixing average repetition rate signals at a given brightness level to produce multiple brightness levels without flicker.

Accordingly, it is an object of this invention to provide improved ROS control of a plasma panel display.

It is another object of this invention to provide a plasma panel display wherein flicker is substantially eliminated.

It is still another object of this invention to provide various controllable brightness levels in a plasma panel display, all without flicker.

DISCLOSURE OF THE INVENTION

The present invention relates to an AC plasma display panel assembly wherein a ROS assumes control of the individual control functions of write, erase, and sustain. The normal operation of the plasma panel display is the sustain function, which is interrupted by a write or an erase function. A ROS not only stores the individual control sequences of the write, erase, and sustain signals, but also selectively initiates the proper control sequences upon receipt of write or erase commands from a data processing system or controller.

A sustain, write, or erase signal is not the same as a sustain, write, or erase operation. Each of the three operations, i.e., sustain, write, and erase refers to functions required to enable data to be selectively displayed on the plasma panel. A sustain operation provides the required voltage and time relationships which combine with the wall charge in the illuminable cells to maintain the cells in their prescribed state. A write operation provides the required voltage and time relationship to the illuminable cells to allow new data to be selectively displayed on the panel. An erase operation provides the required voltage and time relationships to the illuminable cells to allow data to be selectively removed from the plasma panel display.

The sustain, write, and erase operations are effected by drivers acting upon the illuminable cells. The information that controls the operation of the drivers comes from signals stored in the ROS. The ROS is partitioned into sections, each of the sections containing all of the control lines necessary for effecting the sustain, write, and erase operations. The sustain signal is composed of two oppositely phased signals, i.e., the positive sustain signal and the negative sustain signal. Successive sustain signals are sequentially applied in opposite phases so that a positive sustain signal always follows a negative sustain signal and vice versa. However, it will be appreciated that a full sustain signal would be applied to one set of conductors while the orthogonal array is maintained at a reference potential.

The erase and write functions also contain sequences of the sustain signal. The frequencies of the sustain signals contained in the erase and write functions are chosen so that the average repetition rate of a write or erase function is equivalent to the repetition rate of the sustain function. By so doing, the slower frequency erase and write signals are compensated for by higher frequency sustain signals so that the sustain function, erase function, and write function all operate at the same average repetition rate. In this manner, no flicker occurs during those times when information is either being written on or erased from the plasma panel display.

To enable the selection of various brightness levels without flicker, high repetition rate functions and low repetition rate functions are stored within the ROS. That is, erase, write and sustain signals having a multiplicity of frequencies are stored in the ROS so that these signals may be mixed to obtain erase, write and sustain functions which operate at more than one average repetition rate. For example, a high average repetition rate and a low average repetition rate may be chosen to operate the individual functions of sustain, write and erase. By so doing, one obtains a plasma panel display which can operate at two different brightness levels without flicker.

Once this is done, the time spent at either one of the two brightness levels may be modulated so that different brightness levels between the two extremes of high and low may be obtained. All of this is done without flicker. The brightness level of the display will then depend upon the duty factor of the modulation signal. That is to say, for a given period of time, if the higher level brightness functions are chosen more often than the lower level brightness functions then the brightness level of the display will be closer to the high level brightness. Conversely, if the low level functions are chosen more than the high level functions, then the brightness of the display for the same period of time will be closer to the low level brightness. By modulating this duty factor, a whole range of brightness levels can be obtained having only a high level and a low level function stored in the ROS.

The transition from one brightness level to another is a smooth one. There are no discrete steps or jumps from one brightness level to the next. In this regard, the brightness modulation control behaves like a light dimmer.

BEST MODE FOR CARRYING OUT THE INVENTION

Figure 1:
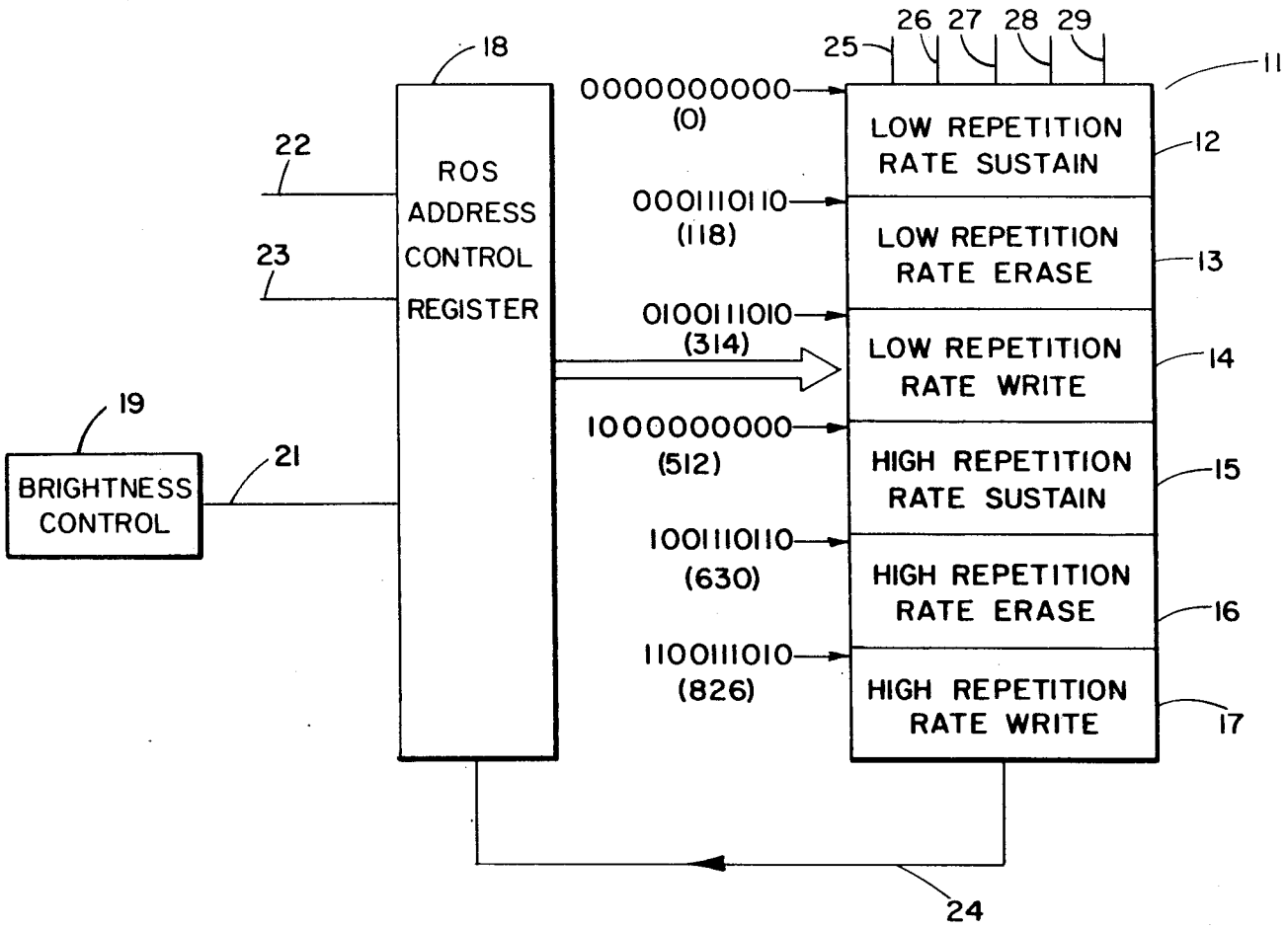
FIG. 1 is a block diagram of the preferred embodiment of the present invention.

The preferred embodiment of the present invention is shown in FIG. 1. The individual sequences of the sustain, write, and erase signals are shown in ROS 11. As can be seen ROS 11 contains both a low repetition rate and a high repetition rate section for each of the three control functions of sustain, write, and erase. The starting addresses of each of the six sections of the ROS are shown to the left of ROS 11 in both binary and decimal format.

Figure 2:
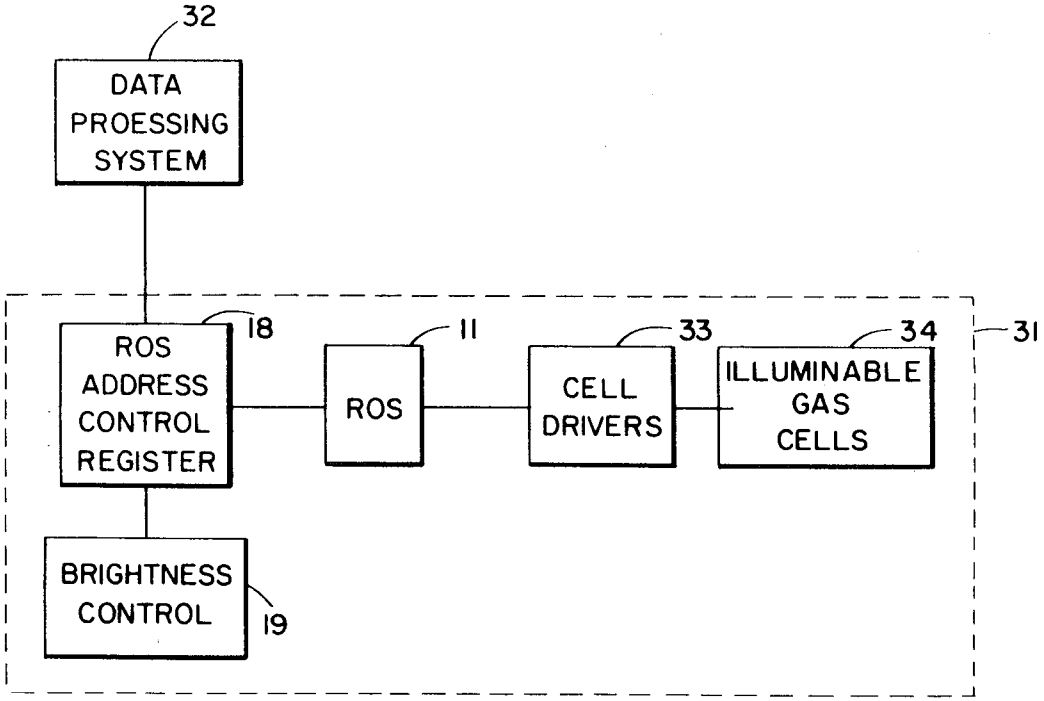
FIG. 2 is a block diagram of the overall system which comprises the environment for the present invention.

Lines 25 through 29 go to cell drivers 33 (FIG. 2) external to the ROS which physically apply the control signals to the illuminable cells 34. Lines 25 and 26 are the positive sustain and negative sustain lines respectively, i.e., they carry the positive sustain and negative sustain signals to the aforementioned drivers 33. Lines 27 and 28 are the write and erase lines respectively, i.e., they carry the write and erase signals to drivers 33. Line 29 is the control line which cooperates with write and erase control lines 27 and 28 to effect a write or erase operation.

ROS address control register 18 is used to access and activate the appropriate control sequence in ROS 11 when the address of that sequence is applied to the control register 18. Lines 22 and 23 are the write and erase inputs to ROS address control register 18, respectively. Line 21 is the brightness control input to ROS address control register 18 which modulates the mixing of the low and high repetition rate sequences in response to the output of brightness control 19.

In the preferred embodiment of the present invention, brightness control 19 is a single shot multi-vibrator which periodically changes states. As is well known, the period of a single shot may be adjusted by varying the value of resistance used in the single shot circuit. In the application used herein, the period of the single shot should be on the order of 5 milliseconds in order for the plasma panel display to appear nonflickering to the human eye. The length of time that the single shot remains in one state will determine how bright the plasma panel display becomes. For example, one state of the single shot determines how long low repetition rate signals are applied to the illuminable cells, while the other state of the single shot determines how long the high repetition rate signals are applied to the illuminable cells 34. Recall that the brightness level of the plasma panel display is directly proportional to the average repetition rate of the control signals applied to the illuminable cells. The higher the repetition rate is, the brighter the plasma panel display will be. Thus by setting the single shot, one can determine the brightness of the plasma panel display.

Figure 3:
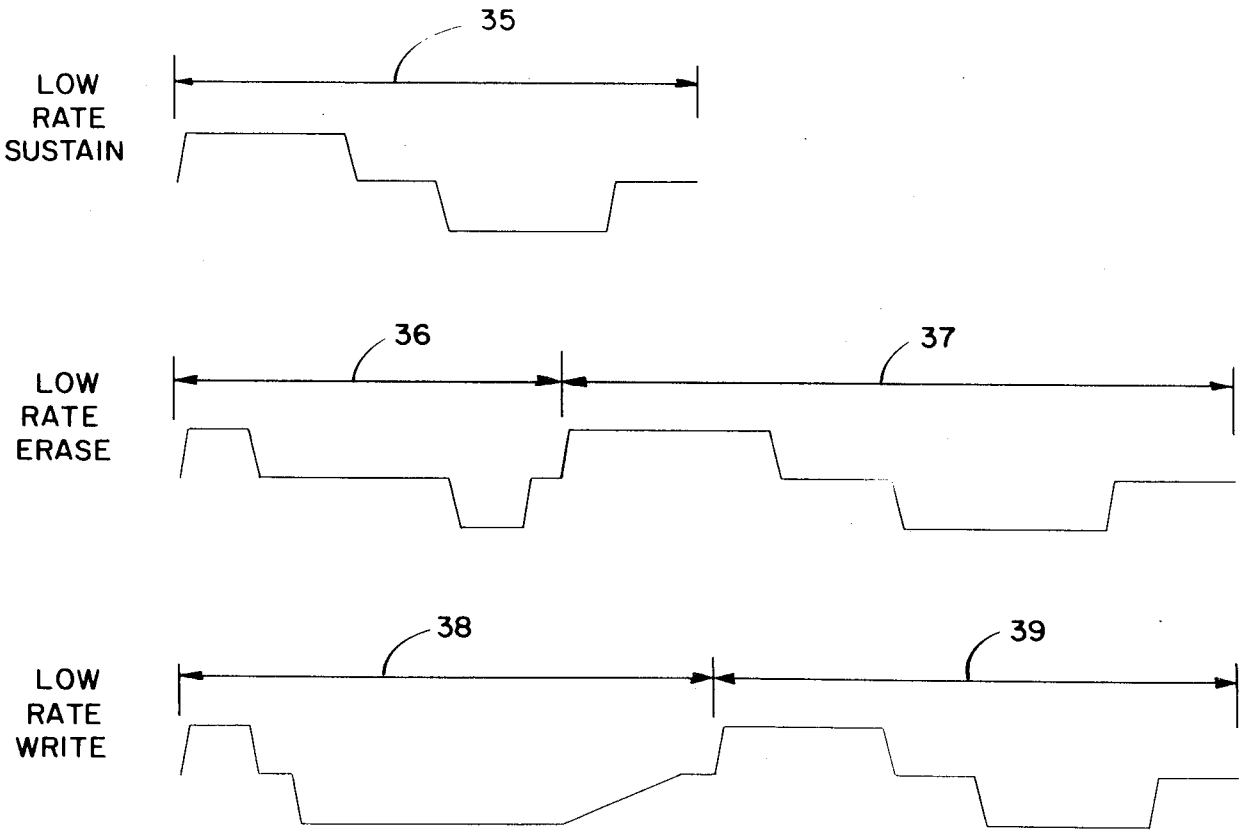
FIG. 3 is a timing diagram of the sustain, write, and erase control sequences for the low repetition rate functions.

FIG. 3 displays the waveforms for the low repetition rate signals contained within ROS 11. For example, the low repetition rate sustain waveform shown in FIG. 3 is contained within section 12 of ROS 11 shown in FIG. 1. Likewise, the low repetition rate erase waveform shown in FIG. 3 is contained in section 13 of ROS 11 shown in FIG. 1.

Figure 4:
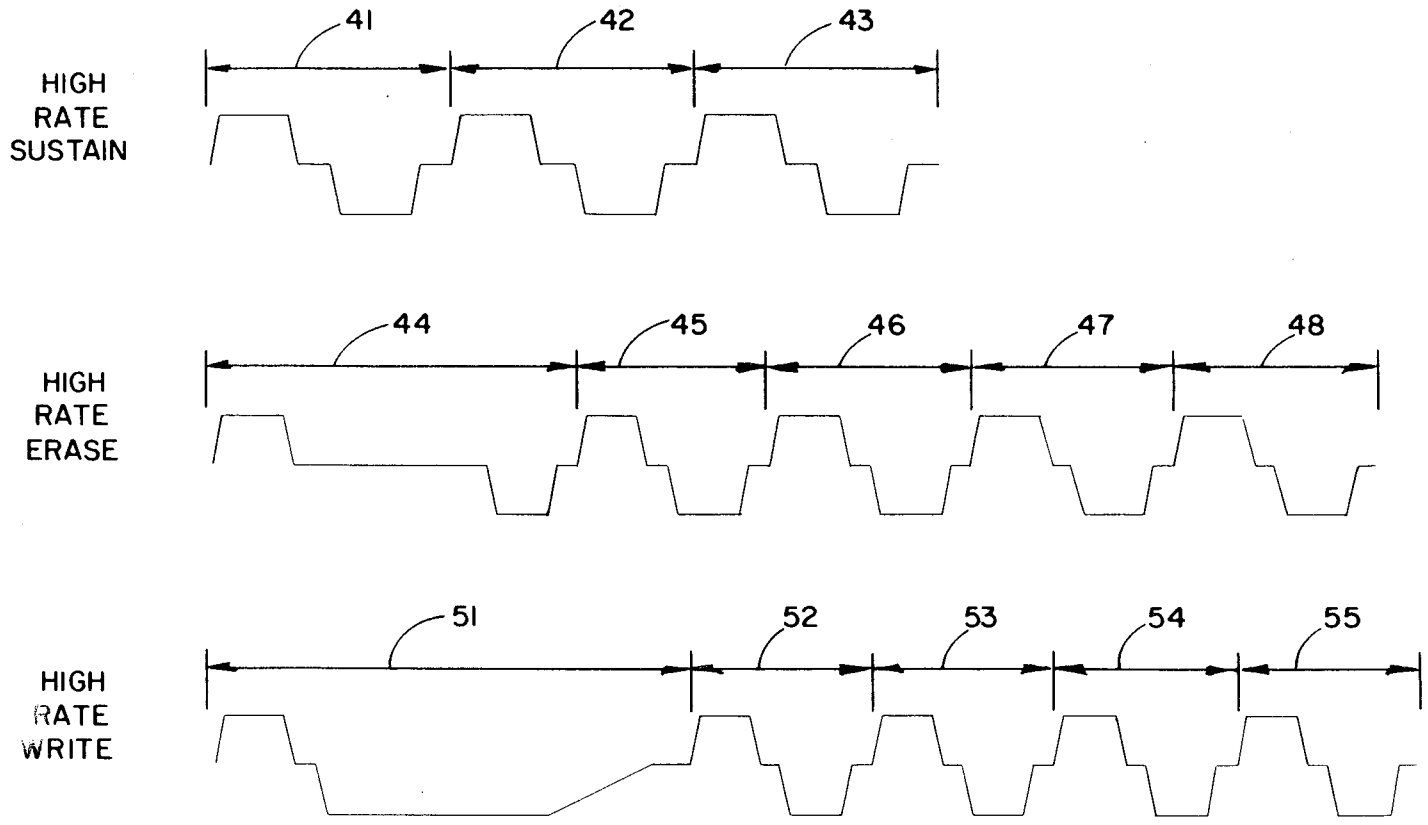
FIG. 4 is a timing diagram of the sustain, write, and erase control sequences for the high repetition rate functions.

FIG. 4 displays the waveforms representing the high repetition rate signals which are contained within ROS 11. For example, the high repetition rate sustain waveform shown in FIG. 4 is contained within section 15 of ROS 11. Similarly, the high repetition rate erase waveform shown in FIG. 4 is contained within section 16 of ROS 11. Looking more closely at FIG. 4, one can see that several different frequency signals are contained within a given waveform. For example, the high repetition rate erase waveform contains five separate sequences 44 through 48. Sequence 44 is an erase control signal which operates at a frequency of approximately 21 kilohertz. Sequences 45 through 48 are sustain control signals which operate at a frequency of approximately 50 kilohertz. The average repetition rate of the high repetition rate erase waveform is found by averaging the periods of each of the signals contained within the erase waveform and taking the reciprocal of them. Doing this for the high repetition erase results in an average repetition rate of approximately 40 kilohertz.

The high repetition rate sustain and write functions are programmed within the ROS so as to also have an average repetition rate of 40 kilohertz. The high repetition rate sustain waveform has three individual sequences 41, 42, and 43 of sustain signals each with a repetition rate of 40 kilohertz. Thus, the repetition rate for the entire waveform is 40 kilohertz.

The high repetition rate write waveform comprises a write signal shown in sequence 51 and four sustain signals shown in sequences 52 through 55. The erase signal shown in sequence 51 has an average repetition rate of 17 kilohertz. The sustain signals shown in sequences 52 through 55 have an average repetition rate of approximately 58 kilohertz. The average repetition rate for the high repetition rate write waveform can then be found as was done above and results in a rate of approximately 40 kilohertz. Thus, the high repetition rate sustain, erase, and write functions shown in FIG. 4 contain sequences of signals which average out to a repetition rate of 40 kilohertz.

The low repetition rate sustain waveform shown in FIG. 3 contains a single sustain signal as depicted in sequence 5. This sustain waveform has a repetition rate of approximately 16 kilohertz. The low repetition rate erase waveform contains a single erase signal shown in sequence 36 and a single sustain signal shown in sequence 37. The erase signal of sequence 36 has a repetition rate of approximately 20 kilohertz while the sustain signal shown in sequence 37 has a repetition rate of approximately 13 kilohertz. When averaged together, these two signals provide an average repetition rate for the low repetition rate erase waveform of approximately 16 kilohertz. This equals the repetition rate of the sustain waveform.

The low repetition rate write waveform contains a single sequence 38 of a write signal having a repetition rate of approximately 16 kilohertz and it also contains a single sequence 39 of a sustain signal having a repetition rate also of approximately 16 kilohertz. When averaged together, these two sequences provide a low repetition rate write waveform with an average repetition rate of 16 kilohertz. Thus, each of the functions shown in FIG. 3 operate at the low repetition rate of 16 kilohertz. The sequences of sustain signals which follow the write and erase signals shown in FIG. 3 and 4, are required in order to properly complete the write and erase functions. Once a write or erase function has been initiated, then the appropriate sustain signals shown in FIGS. 3 and 4 must be completed in order to successfully complete the write or erase operation. For example, referring to FIG. 4, sequences 45 through 48 must follow sequence 44 in order to successfully complete that erase function. Once sequence 44 has commenced, the ROS cannot access any other of the sections 12 through 17 until sequence 48 has been completed.

As is well known, the operating frequencies of a plasma panel display are not chosen totally arbitrarily but are dependent to some extent upon the physics of the gas panel display. Looking first at the high repetition rate function, it is well known that a plasma panel display should not operate at frequencies higher than 60 kilohertz. At frequencies above 60 kilohertz, the operating margin of the display decreases, resulting in a much poorer quality display. Through experimentation, 40 kilohertz has been determined to be a maximum frequency at which to operate the sustain function. Once this frequency has been set, then the write and erase frequencies are set by the frequency that provides the ionization potentials necessary to effect the wall charge potential of the cells to perform a write or erase function.

After the sustain repetition rate is set at 40 kilohertz, the erase and write signals are determined according to the procedure outlined above. It is desired to set the average repetition rate of the erase and write function equal to the average repetition rate of the sustain function which is 40 kilohertz. Since the erase and write signals contained within the erase and write functions respectively have already been determined, the only way in which the erase and write functions can have a 40 kilohertz average repetition rate is to adjust the repetition rate of the sustain signals contained within the write and erase function so that the entire erase and write functions average out to 40 kilohertz. The necessary repetition rate for sequences 45 through 48 and 52 through 55 have been given above.

With respect to the low repetition rate functions, the limiting factor is noise. When a plasma panel operates below a certain frequency, the panel emits an annoying noise. To eliminate the noise problem, the average repetition rate for these lower level signals have been chosen to be approximately 16 kilohertz. As has been explained with respect to the higher repetition rate functions, a repetition rate for the sustain function is chosen and then the repetition rates for the erase and write functions are dependent on the sustain function frequency and gas panel physics. Likewise as explained with respect to the higher repetition rate functions, the sustain signals contained within the erase and write functions are chosen such that the average repetition rates of the erase and write functions is equal to the average repetition rate of the sustain function.

Thus, the low repetition rate functions shown in FIG. 3 and the high repetition rate functions shown in FIG. 4 are the limiting repetition rate at which a plasma panel may operate. At the low repetition rate end, one seeks to avoid noise, while at the high repetition rate end, one seeks to avoid a loss of display margin.

As described heretofore, the brightness of the cells in a plasma panel display are directly proportional to the repetition rate of the control signals applied thereto. If a plasma panel display is being sustained at a rate of 40 kilohertz, and then it is desired to write on the display, the write function must be performed at 40 kilohertz in order to prevent dimming of the display. For example, if the display is being sustained at 40 kilohertz, but the write function operates at 20 kilohertz, then a flicker or dimming of the display will occur during the write sequence. The avoidance of this dimming during write and erase sequences is the reason for setting the average repetition rate of the erase and write functions equal to the average repetition rate of the sustain function.

Having a low repetition rate set of functions stored in the ROS in ROS 11 and a high repetition rate set of functions stored in ROS 11 allows two different brightness levels for the display while reducing flicker. Brightness control modulation 19 allows the panel to operate at more than two brightness levels while maintaining its flicker free status. Depending on how brightness control 19 is set, the plasma panel display can have any brightness between the limiting extremes determined by the low repetition rate and high repetition rate functions shown in FIGS. 3 and 4, respectively. It must be emphasized that the switching rate of brightness control 19 is faster than the perceptibility of the human eye. Thus as the brightness of the plasma panel display is varied by modulating the time at which the low and high repetition rate functions are operated, no flicker or dimming is perceived by the human eye.

The operation of ROS 11 and ROS Address Control Register 18 will now be described in more detail with reference to FIG. 1. The starting addresses for each of the six sections of ROS 11 are shown in binary and decimal (in parentheses) format to the left of ROS 11. For example, 0000000000 is the starting address for the low repetition rate sustain function. Likewise, 0001110110 (118) is the starting address for the low repetition rate erase function. Note that the low repetition rate sustain function found in section 12 has the same binary address as the high repetition rate sustain function found in section 15 except for the leftmost position of the address. Similarly, the high repetition rate erase function found in section 16 and the high repetition rate write function, found in section 17 have the same starting addresses as their respective low repetition rate counterparts found in sections 13 and 14, respectively except for the leftmost address position.

The leftmost address position, which determines whether a low repetition rate function or a high repetition rate function will be addressed, is determined by the state of brightness control 19. Recall that in the preferred embodiment of the present invention, brightness control 19 comprises a single shot multi-vibrator having either a binary zero or a binary 1 output. The output of the single shot is transmitted over line 21 to ROS address control register 18. This single bit serves as the leftmost address position in the ROS address control register 18. Thus, if the bit transmitted over line 21 is a zero, then the leftmost bit position will be a zero, and the low repetition rate functions will be addressed. On the other hand, if the bit outputted over line 21 is a one, then the leftmost bit position of the address selected will be a one and the high repetition rate functions will be addressed. Note too that the decimal representations for the starting addresses of the high repetition rate functions are equal to the starting addresses of the low repetition rate functions when these representations are added to the number 512.

When power is initially applied to the plasma panel display, ROS address control register 18 is reset to zero, the address position associated with the sustain function. If brightness control 19 is in the zero state, then the low repetition rate sustain function will be activated. If brightness control 19 is in the one state, then the high repetition rate sustain function will be activated. At the conclusion of the addressed sustain function, line 24 signals ROS address control register 18 that the sustain function has been completed. Although shown only as a single connection, line 24 is connected to the last bit position in each of the sections 12 through 17. When that last bit position is read, line 24 reaches an up level thus signalling ROS address control register 18 that the addressed section of ROS 11 has been completely read.

After line 24 signals ROS address control register 18 that the previously addressed section in ROS 11 has been completed, lines 22 and 23, which are the erase and write inputs, respectively, are scanned by register 18. If both of these inputs are low, signifying that neither a write or an erase operation is to be performed, then control register 18 once again accesses either sustain function 12 or sustain function 15. As explained heretofore, brightness control 19 determines whether the low repetition rate or the high repetition rate function is to be accessed. As is well know, the sustain function is the normal operating mode of a plasma panel display. The only time that the sustain function is not addressed is when a write or an erase command is received over lines 22 and 23.

The operation of the invention will now be briefly explained for the situation when an erase operation is to be performed. First, a controller or data processing system 32 external to plasma panel 31 strobes line 22 so as to indicate that an erase operation is to be commenced. After line 24 signals ROS address control register 18 that the addressed section in ROS 11 has been read, the register 18 scans its contents. Finding that line 22 has become active, the register accesses either low repetition rate erase section 13 or high repetition rate erase section 16. Once again, whether the high or the low rate function is accessed depends upon the state of brightness control 19. After the chosen erase section has been completely read, the ROS address control register 18 is once again scanned. If neither line 22 signifying an erase operation nor line 23 signifying a write operation has been strobed, then one of the two sustain sections (12, 15) are accessed and read through. This process continues for as long as the plasma panel display is in operation.

While the invention has been particularly shown and described with reference to a preferred embodiment thereof, it will be understood by those skilled in the art that the foregoing and other changes in form and detail will be made therein without departing from the spirit and scope of the invention.

What is claimed is:

1. A plasma panel display system comprising:

a plurality of addressable control signals to gate energizing signals to illuminable cells in a panel display, means responsive to each of said control signals for gating said energizing signals at a different one of a plurality of repetition rates;

a storage device for storing said control signals; and addressing means for addressing selected ones of said stored control signals in combination which produce groups of said energizing signals having a uniform repetition rate for each group.

2. A system according to claim 1 having a display sustain function comprised of a sequence of signals of different selectable repetition rates, a display erase function comprised of a sequence of signals of different selectable repetition rates, a display write function comprised of a sequence of signals of different selectable repetition rates.

3. A system according to claim 2 wherein said display sustain function, said display write function and said display erase function are held at a uniform repetition rate by selection of the repetition rate for each function to make the average repetition rates equal.

4. A system for selectively controlling the discharge state of a plurality of illuminable cells in a plasma display device, said plurality of illuminable cells having a brightness proportional to the repetition rate of energizing signals applied thereto, said system comprising in combination:

a source for a plurality of control signals for gating said energizing signals to said illuminable cells, each of said control signals having one of a plurality of repetition rates;

a storage device for storing said plurality of control signals;

addressing means for accessing said storage device and for generating sequences of control signals, each sequence having a uniform repetition rate by selectively reading out said plurality of control signals in a predetermined order; and driving means which gates said energizing signals to said illuminable cells for preventing flicker in said plasma display device by gating said uniform repetition rate sequences of energizing signals to said plasma display device to effect a uniform discharge rate of said plurality of cells, whereby said plurality of cells maintains a uniform brightness in response to said gating of uniform repetition rate energizing signals.

5. A system according to claim 4 having a display sustain function comprised of a sequence of signals of different selectable repetition rates, a display erase function comprised of a sequence of signals of different selectable repetition rates, a display write function comprised of a sequence of signals of different selectable repetition rates.

6. A system according to claim 5 wherein said driving means applies said first, second, and third sequences of energizing signals to said plasma display device thereby maintaining a uniform brightness during execution of said sustain function, said erase function, and said write function.

7. A system for providing control of a plasma display device having illuminable cells comprising:

a plurality of control signals for gating energizing signals to said illuminable cells, each of said control signals having one of a plurality of repetition rates;

a storage device for storing said control signals;

control means for selectively addressing said control signals to combine the repetition rates of said energizing signals driven by said control signals;

wherein the average repetition rate of the combination is controlled by said control means.

8. A system according to claim 7 wherein said control means mixes said first average repetition rate sequences and said second average repetition sequences in varying proportions, thereby producing a plurality of additional sequences having average repetition rates between said first average repetition rate and said second average repetition rate.

9. A method for operating a plasma panel display composed of illuminable cells whose discharge rate is proportional to the repetition rate of control signals applied thereto, said method comprising the steps of:

generating a first sequence of control signals having a first repetition rate;

generating a second sequence of control signals having a second repetition rate lower than said first repetition rate;

generating a third sequence of control signals having a third repetition rate higher than said first repetition rate;

combining said second sequence of control signals and said third sequence of control signals to produce a first group of control signals having an average repetition rate substantially equal to said first repetition rate over a period of time substantially equal to said first sequence;

gating said first group of control signals to said illuminable cells.

10. A method according to claim 9 further comprising the steps of:

generating a fourth sequence of control signals having a fourth repetition rate;

generating a fifth sequence of control signals having a fifth repetition rate lower than said fourth repetition rate;

generating a sixth sequence of control signals having a sixth repetition rate higher than said fourth repetition rate;

combining said fifth sequence of control signals and said sixth sequence of control signals to produce a second group of control signals having an average repetition rate substantially equal to said second repetition rate over a period of time substantially equal to said first sequence;

gating said second group of control signals to said illuminable cells.

11. A method according to claim 10 further comprising the step of modulating the application of said first and said second groups of control signals.

12. A method according to claim 11 further comprising the steps of:

storing said generated sequences of control signals in a storage device; and reading said generated sequences of control signals out of said storage device prior to applying said groups of control signals to said illuminable cells.

13. A system for selectively controlling the discharge rate of a plurality of illuminable cells in a plasma display device, said plurality of illuminable cells having a brightness proportional to the repetition rate of control signals applied thereto, said system comprising:

a plurality of addressable control signals for gating energizing signals to said illuminable cells;

a plurality of control signals, each having one of a plurality of repetition rates;

a storage device for storing said control signals;

control means for selectively addressing said control signals to combine the repetition rates of said energizing signals gated by said control signals;

wherein the average repetition rate of the combination is controlled by said control means, and driving means for varying the brightness level of said plasma display device by applying said modulated sequence of control signals to said plurality of cells, whereby the brightness level of said plasma display device may be controllably varied by modulating the order in which said control signals are read out from said storage device.

14. A system according to claim 13 wherein said sustain function comprises a first sequence having a first plurality of sustain control signals, said erase function comprises a second sequence having a first erase control signal and a second plurality of sustain control signals, and said write function comprises a third sequence having a first write control signal and a third plurality of sustain control signals, each of said first, second, and third sequences having a first average repetition rate.

15. A system according to claim 14 wherein said sustain function further comprises a fourth sequence having a fourth plurality of sustain control signals, said erase function further comprises a fifth sequence having a second erase control signal and a fifth plurality of sustain control signals, and said write function comprises a sixth sequence having a second write control signal and a sixth plurality of sustain control signals, each of said fourth, fifth, and sixth sequences having a second average repetition rate greater than said first average repetition rate.

16. A system according to claim 15 wherein said control means mixes said first average repetition rate sequences and said second average repetition rate sequences in varying proportions, thereby producing a plurality of additional sequences having average repetition rates between said first average repetition rate and said second average repetition rate.

17. A system according to claim 16 wherein said driving mean applies said plurality of additional sequences to said plurality of cells to produce a plurality of brightness levels, whereby the number of brightness levels produced is equivalent to the number of additional sequences.

* * * * *